United States Patent [19]

Sato et al.

[11] 4,102,452

[45] Jul. 25, 1978

[54] STORAGE CASE

[75] Inventors: Masaaki Sato, Hachioji; Shoichi Saito, Tokyo, both of Japan

[73] Assignee: Olympus Optical Co., Ltd., Tokyo, Japan

[21] Appl. No.: 643,859

[22] Filed: Dec. 23, 1975

[30] Foreign Application Priority Data

Dec. 25, 1974 [JP] Japan ..... 50-4169[U]

[51] Int. Cl.[2] ..... B65D 43/16; B65D 51/04; B65D 85/67

[52] U.S. Cl. ..... 206/387; 220/337; 220/339

[58] Field of Search ..... 206/387, 379, 266; 220/339, 337, 334; 242/71.1

[56] References Cited

U.S. PATENT DOCUMENTS

| | | | |
|---|---|---|---|
| 2,411,946 | 12/1946 | Vogel | 206/266 |
| 3,104,846 | 9/1963 | Ringle | 242/71.1 |
| 3,154,192 | 10/1964 | Cowley | 206/379 |
| 3,346,099 | 10/1967 | Thomas et al. | 220/339 |
| 3,651,983 | 3/1972 | Haugen | 220/339 |
| 3,876,071 | 4/1975 | Neal et al. | 206/387 |
| 3,954,179 | 5/1976 | Warmath | 220/337 |
| 4,011,940 | 3/1977 | Neal et al. | 206/387 |

*Primary Examiner*—William T. Dixson, Jr.

[57] ABSTRACT

A synthetic resin storage case which comprises a case body, a covering formed integrally with said case body, and a rear side plate which is provided between said case body and said covering and through which said covering is rocked, whereby when said covering is closed, a front side plate of said case body is overlapped on a front side plate of said covering to maintain said covering in a closed condition by an engaging mechanism provided between both said front side plates. It further comprises a shifting mechanism for slightly shifting said covering toward said rear side plate in accordance with the rocking movement of said covering at the time of closing said covering, so as to secure the function of said engaging mechanism.

11 Claims, 4 Drawing Figures

STORAGE CASE

BACKGROUND OF THE INVENTION

This invention relates to a storage case or box suitable for loading or storing, for example, a cartridge or cassette of film, magnetic tape, etc.

Conventionally, as this type of storage case there is known the one wherein a storing body having a front side plate and right and left side plates, a covering for covering an upwardly directed opening of the storing body, and a rear side plate commonly connected to the storing body and covering are integrally formed of synthetic resin material; and the rear side plate is made to function as a hinge to make possible the opening and closing operation of the covering. In such type of storage case, in order to prevent the covering from being opened, when having been closed, due to a restoring force of the rear side plate, there is provided an engaging mechanism wherein either one of the mutually overlapping front side plates of the storing body and covering is provided with an engagement projection and the other with an engagement depression engageable with this projection. Since, however, in this engaging stopper mechanism, the engaging function is performed when the engagement projection is inserted into the engagement depression, it is not reliably performed unless both front side plates of the storing body and covering are closely approached to each other, and even when the covering is closed, application of a small external force causes the covering to be opened soon. Since, however, a dimensional tolerance for permitting both front side plates to overlap on each other should be provided and dimensional errors upon manufacture are produced, it often happens, actually, that both front side plates fail to be mutually closely approached to a required extent. This poses the above-mentioned problems.

SUMMARY OF THE INVENTION

The object of the invention is to provide a storage case so constructed that when the covering is closed, it is a little shifted toward the rear side plate for purpose of causing both front side plates of the case body and covering to closely approach each other so as to permit the engaging stopper mechanism to exhibit its function sufficiently.

According to the invention, since the engagement of the covering with the storage case body has been made reliable by a shift of the covering toward the rear side plate, there is further provided a mechanism which, when the covering is opened, can easily release said engaged condition.

DETAILED DESCRIPTION OF THE PREFERRED EMBODIMENTS

A storage case according to an embodiment of the invention is hereinafter explained with respect to the case where the storage case is a compact tape cassette storage case, by reference to the appended drawings.

Figure 1:
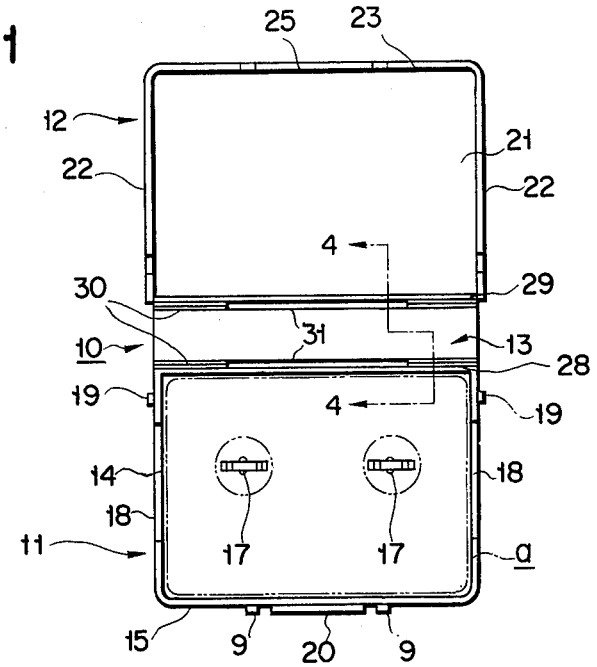
FIG. 1 is a plan view of a storage case according to an embodiment of the invention in a state wherein its covering is fully opened.
Figure 2:
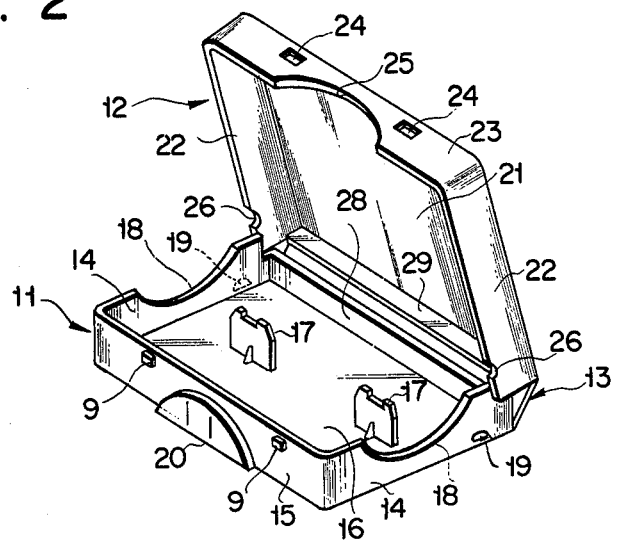
FIG. 2 is a perspective view of the storage case in an opened state.
Figure 3:
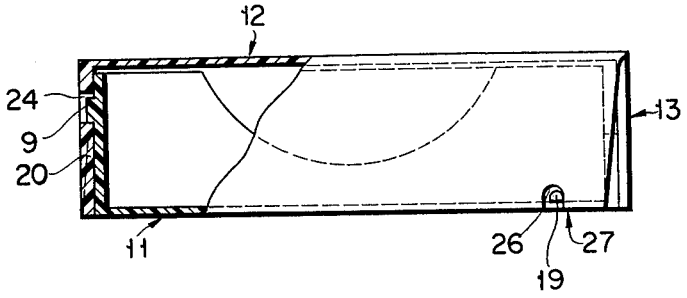
FIG. 3 is a longitudinal sectional view of the storage case in a closed state.
Figure 4:
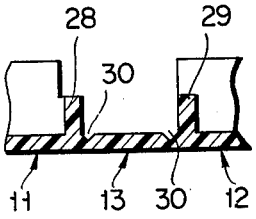
FIG. 4 is a sectional view taken along the line 4—4 of FIG. 1.

A case 10 is flat box-shaped, and comprises a body 11, a covering 12, and a rear side plate 13 commonly connecting the body 11 and covering 12, and these 11, 12 and 13 are formed by integrally molding synthetic resin. The receptacle body 11 has right and left side plates 14 and a front side plate 15, and these 14, 15 are allowed to project with the same height from a bottom plate 16 at right angles thereto. On the inner face of the bottom plate 16 there are projectively provided at right and left symmetrical positions a pair of rotation-preventing pawls 17 which, by being inserted into reels of a compact tape cassette *a* to be stored or loaded, prevent the reel rotation. The upper faces of the right and left side plates 14 are formed substantially at the central portions with cassette taking-out cutting-sections 18 and assuming an arc like configuration, respectively. Further, the outer faces of the side plates 14 are projectively formed with semicircular disc like projections 19 at lower portions near to their rear ends, respectively. On an upper part of the outer face of the front side plate 15 there are provided at right and left-symmetrical positions a pair of engagement projections 9, respectively, and on a lower part of said outer face there is provided a semicircular disc like, finger-applied section 20 in such a manner as to be situated between the pair of engagement projections 9 and as to permit its arc like side face to be directed upwards. The covering 12 also has a pair of right and left side plates 22 projectively provided on an upper plate 21 perpendicularly to the same 21, and a front side plate 23. The dimensions of these side plates 22, 23 are so determined that when the covering 12 is closed, the inner faces of the side plates 22, 23 are overlapped on the outer faces of the side plates 14, 15 of the receptacle body 11 in a close relation thereto. An upper part of the front side plate 23 of the covering 12 is formed with a pair of fitting portions, for example, a pair of apertures 24, which, when the covering 12 is closed, are fitted over said engagement projections 9 to constitute an engaging mechanism together with the engagement projections 9. An intermediate part of the front side plate 23 is formed with an arc like notch 25 which is opened toward the lower end of the front side plate 23 and into which, when the covering 12 is closed, the finger-applied section 20 is inserted. Rear parts of the right and left side plates 22 of the covering 12 are formed with a pair of U-shaped notches 26, respectively, which are opened toward the lower ends of the side plates 22, respectively, and when the covering 12 is closed, engage the engagement projections 19 respectively. Rearward inner faces of the notches 26 are allowed to abut, from just before the covering-closing state is completed, against rearward side faces of the engagement projections 19 provided, respectively, on the side plates 14 of the case body 11, thereby causing the covering 12 to be a little shifted or biased rearwardly. In this way, the projections 19 and notch 26 constitute a shifting or biasing mechanism 27. In the drawings, a reference numeral 28 denotes an internal rear side plate of the case body 11 and 29 an internal rear side plate of the covering 12. The height of these plates 28, 29 is equal to substantially half the height of the other side plates, and when the covering 12 is closed, the free end faces of both plates 28, 29 are allowed to abut against or approach each other so as to permit the case interior to be sealed substantially hermetically. When the case 10 is manufactured, the rear side plate 13, as shown in FIG. 1, is formed between the bottom plate 16 of the receptacle body 11 and the upper plate 21 of the covering 12 in a manner made flush with these plates 16, 21. The inner face of the boundary portion between the rear side plate 13 and each of the case body 11 and covering 12 is formed with a groove 30 whose cross section is V-shaped and which extends along the rear plates 28, 29. When the covering 12 is closed, the rear side plate 13 is bent, at these grooves 30, inwardly with respect to the case body 11 and the covering 12. An intermediate portion of each groove 30 is formed with a slit 31 so as to permit the plate 13 to be easily inwardly bent at the groove 30.

Where, in the case having the foregoing construction, the covering 12 is closed, the notch 26 of the covering 12 is allowed to abut against the rearward face of the projection 19 of the case body 11 to cause the covering 12 to be shifted or biased relatively to the case body 11 toward the rear side plate 13. As a result, the inner face of the front side plate 23 of the covering 12 comes closer to the outer face of the front side plate 15 of the case body 11, thereby causing the aperture 24 of the covering 12 to be reliably engaged with the projection 19 of the case body 11, so that even when an external force is somewhat applied to the case 10, it never happens that the covering 12 is opened unexpectedly.

Where the covering 12 is desired to be opened, the inward pushing of the finger-applied section 20 of the body 11 exposed exteriorly through the notch 25 of the covering 12 causes the front side plate 15 of the body 11 to be bent inwardly, so that the engagement projection 19 is disengaged from the aperture 24 to enable the covering 12 to be easily opened.

Where the compact tape cassette *a* stored within the case body 11 is desired to be taken out, the user inserts his fingers into the cassette taking-out sections 18 provided for the right and left side plates 14 and grips that portion of the cassette *a* which is exposed from the section 18, thereby taking the cassette *a* out.

The preceding embodiment referred to the case where the biasing mechanism 27 of the case 10 is constituted by the engagement projections 19 provided on the case body 11, and the U-shaped notches 26 formed in the covering 12, but, according to the invention, the notch and the engagement projection may be provided for the case body and the covering, respectively, and further a pair of mutually engageable projections may be provided for both the body and covering, respectively. Furthermore, said projection and notch, or said paired projections may be provided at other positions. For example, a projection which, when the covering is closed, abuts on the inner face of the rear side plate 13 to urge or bias the same 13 rearwardly or exteriorly may be provided on the outer face of the internal rear side plate 28 of the case body.

The preceding embodiment referred to the case where the engaging mechanism of the case 10 acting when the covering 12 is closed is constituted by the engagement projection 9 provided on the case body 11, and the aperture 24 formed in the covering 12, but, according to the invention, a depression, in lieu of the aperture 24, may be provided for the inner face of the front side plate 23, and further an aperture or depression, and an engagement projection may be provided for the case body 11 and the covering 12, respectively, and further a pair of mutually engageable projective pieces may be provided for both the body and covering, respectively.

The preceding embodiment referred to the case where the groove 30 is provided at the boundary portion between the rear side plate 13 and each of the case body 11 and covering 12, but, according to the invention, this groove 30 may not necessarily be provided, and further the rear side plate 13 itself may be formed thin for achieving the same purpose.

This invention is not limited to the above-mentioned storage case for storing the cassette tape therein and can be applied to any other storage case for mainly storing small articles.

What we claim is:

1. A storage case comprising:

a box-shaped case body having a front side plate, right and left side plates, internal rear side plate and bottom plate which define an upwardly directed opening;

a covering having an upper plate, right and left side plates and front side plate, said upper plate closing said opening of said case body and simultaneously said right and left side plates and front side plate of said covering overlapping said right and left side plates and front side plate of said case body when said covering is closed;

a rear side plate formed integrally with said case body and covering to enable said covering to be tilted relatively to said case body thereby permitting closing of the case;

an engaging mechanism including a first engagement section provided for an outer face of said front side plate of said case body and a second engagement portion provided for an inner face of said front side plate of said covering and, when said covering is closed, engaged with said first engagement section to prevent said covering from being opened; and a shifting mechanism position distally from said engaging means for shifting said covering toward said rear side plate including a pair of projections provided respectively on lower ends of outer faces of each of said side plates of said case body adjacent said rear side plate and leaving abutment faces facing toward said rear side plate respectively, said mechanism further including a pair of notches provided respectively, in lower ends of said right and left side plates of said covering so that when said covering is being closed it is shifted toward said rear side plate by abutment and engagement of said pair of notches on and with said rearward abutment faces of said pair of projections, said notches and said abutment faces disengaged when said case is opened.

2. A storage case according to claim 1, wherein said case body, covering and rear side plate are an integral molded unit of synthetic resin material.

3. A storage case according to claim 2, wherein said rear side plate has a pair of grooves at the boundary sections between said rear side plate and said case body and between said rear side plate and said covering, respectively, to permit said rear side plate to be bent at said pair of grooves relatively to said case body and said covering, respectively.

4. A storage case according to claim 3, wherein said rear side plate has a pair of slits formed, respectively, along said pair of grooves, at intermediate portions thereof.

5. A storage case according to claim 2, wherein the engaging mechanism is a combination of an engagement projection and a groove corresponding thereto.

6. A storage case according to claim 5, wherein said first engagement section of said engaging mechanism is a pair of engagement projections provided on the outer face of said front side plate of said case body at a predetermined distance from each other; and said second engagement section is a pair of apertures provided in said front side plate of said covering at a predetermined distance from each other so that when said covering is closed, said pair of engagement projections are inserted into said pair of apertures, respectively, to complete each engagement therebetween.

7. A storage case according to claim 1, further comprising a finger-applied section projectively provided on the outer face of said front side plate of said case body, whereby said front side plate of said case body is bent inwardly of said case by pushing said finger-applied section with a user's finger to release the engagement of said engagement mechanism.

8. A storage case according to claim 7, wherein said covering has a notched section which is provided for said front side plate of said covering and into which, when said covering is closed, said finger-applied section is extended.

9. A storage case of claim 1 which includes, in addition to a rear side plate, an internal rear side plate affixed to said covering and substantially perpendicular to the upper plate of said covering, a second internal rear side plate affixed to said bottom plate and in perpendicular relationship thereto, said first and second internal rear bottom plates being substantially one half the height of the other side plates, said internal rear side plates and said rear side plate forming in conjunction a substantially hermetic seal when the cover is closed.

10. A storage case for tape cassettes comprising:

a box-shaped case body having a front side plate, right and left side plates, internal rear side plate and bottom plate which define an upwardly directed opening;

retaining means for cassettes affixed to said bottom plate and designed to engage the cassette orifices;

a covering having an upper plate, right and left side plates and front side plate, said upper plate closing said opening of said case body and simultaneously said right and left side plates and front side plate of said covering overlapping said right and left side plates and front side plate of said case body when said covering is closed;

a rear side plate formed integrally with said case body and covering to enable said covering to be tilted relatively to said case body thereby permitting closing of the case;

an engaging mechanism including a first engagement section provided for an outer face of said front side plate of said case body and a second engagement portion provided for an inner face of said front side plate of said covering and, when said covering is closed, engaged with said first engagement section to prevent said covering from being opened; and a shifting mechanism positioned distally from said engaging means for shifting said covering toward said rear side plate including a pair of projections provided respectively on lower ends of outer faces of each of said side plates of said case body adjacent said rear side plate and leaving abutment faces facing toward said rear side plate respectively, said mechanism further including a pair of notches provided respectively, in lower ends of said right and left side plates of said covering so that when said covering is being closed it is shifted toward said rear side plate by abutment and engagement of said pair of notches on and with said rearward abutment faces of said pair of projections, said notches and said abutment faces disengaged when said case is opened.

11. A storage case as claimed in claim 10 which includes in addition to a rear side plate, an internal rear side plate fixed to said covering and substantially perpendicular to the upper plate of said covering, a second internal rear side plate affixed to said bottom plate and in perpendicular relationship thereto, said first and second internal rear bottom plates being substantially one half the height of the other side plates, said internal rear side plates and said rear side plate forming in conjunction a substantially hermetic seal when the cover is closed.

* * * * *